US008201863B1

(12) United States Patent
Konovalov

(10) Patent No.: US 8,201,863 B1
(45) Date of Patent: Jun. 19, 2012

(54) ANIMAL FECES COLLECTION DEVICE

(76) Inventor: Deonisy Konovalov, Molalla, OR (US)

( * ) Notice: Subject to any disclaimer, the term of this patent is extended or adjusted under 35 U.S.C. 154(b) by 0 days.

(21) Appl. No.: 13/030,664

(22) Filed: Feb. 18, 2011

(51) Int. Cl.
*A01K 29/00* (2006.01)
*E01H 1/12* (2006.01)

(52) U.S. Cl. ..... 294/1.4; 15/79.1; 414/440

(58) Field of Classification Search ..... 294/1.3, 294/1.4, 19.2; 15/79.1, 79.2, 83; 414/440
See application file for complete search history.

(56) References Cited

U.S. PATENT DOCUMENTS 425,695 A * 4/1890 Pontious ..... 56/400.13
1,224,349 A * 5/1917 Yessne ..... 15/82
1,580,600 A * 4/1926 Holbrook ..... 15/79.1
3,485,398 A * 12/1969 Offner ..... 414/440
3,591,883 A * 7/1971 Armstrong et al. ..... 15/149
3,668,730 A * 6/1972 Scharmann et al. ..... 15/83
3,959,922 A * 6/1976 Leistikow ..... 446/144
4,765,666 A * 8/1988 Parks ..... 294/1.4
4,966,400 A * 10/1990 Hull et al. ..... 294/1.4

* cited by examiner

*Primary Examiner* — Dean Kramer
(74) *Attorney, Agent, or Firm* — Mark S. Hubert

(57) ABSTRACT

A feces collection system capable of collecting and containing animal feces (either solid or semi solid) for direct disposal or bagged disposal. Disposal of the collected feces may be done through the rear or top disposal hatches. The collection can be done on various depths of grass or gravel as the lower scoop is automatically or manually adjustable. The collection blade rotor has a repeating pattern of three variably sized and shaped blades. The system has a built in water jet cleaning system with an adjustable stream. For ease of steering the device is lightweight, has an extending, pivotable handle and rotatable rear wheels.

15 Claims, 7 Drawing Sheets

FIG. 10
FIG. 11
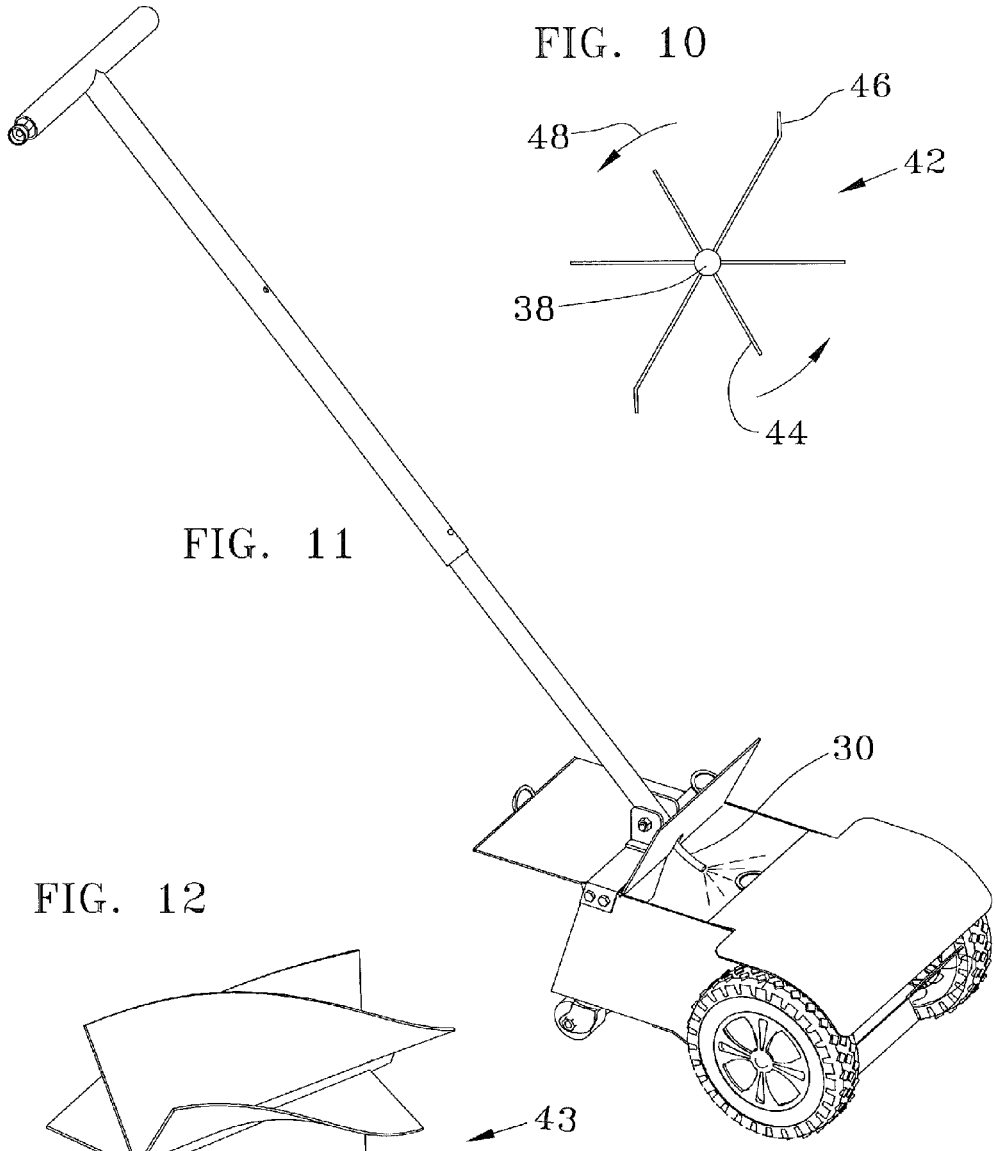
FIG. 12
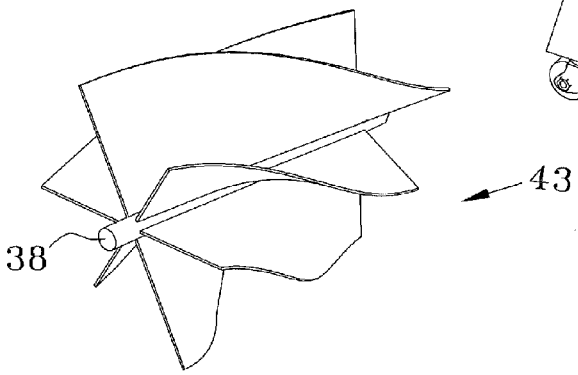

ANIMAL FECES COLLECTION DEVICE

BACKGROUND OF THE INVENTION

The present invention relates to a extremely compact, lightweight animal feces collection device adapted to provide ease, speed, and a hygienic method for feces collection on both grassy and gravelly terrains. More particularly, to a portable device for the sanitary collection of animal feces designed to provide a moderate distance between the animal feces and the pet owner.

The American populace is replete with pets. More and more condos and apartments are now allowing pets. This means more and more pet owners have to walk their pet in public areas. Hand bagging feces is uncomfortable for many and the use of brooms/shovels and dustpans require sanitary storage and cleaning. Simply stated, the conventional methods of feces collection are distasteful to most. Henceforth, a lightweight, inexpensive, feces collection device that could be easily cleansed would fulfill a long felt need in the industry. This new invention utilizes and combines known and new technologies in a unique and novel configuration to overcome the aforementioned problems and accomplish this.

SUMMARY OF THE INVENTION

The general purpose of the present invention, which will be described subsequently in greater detail, is to provide a feces collection device that is able to collect animal feces in grassy or gravelly areas, for disposal or internal bagging for later disposal, in a sanitary method. It has many of the advantages mentioned heretofore and many novel features that result in a new animal feces collection device which is not anticipated, rendered obvious, suggested, or even implied by any of the prior art, either alone or in any combination thereof.

In accordance with the invention, an object of the present invention is to provide an improved feces collection device capable of completely scooping up animal feces and collecting it in a washable enclosure which can then be dumped directly into a waste receptacle or stored in a polymer bag inside the device for eventual removal.

It is another object of this invention to provide an improved feces collection device with an integrated water jet cleaning system.

It is a further object of this invention to provide an improved feces collection device that does not require the user to "stoop to scoop" and is capable of collecting both solid and semi solid feces.

It is still a further object of this invention to provide for an improved feces collection device having a quickly adjustable scoop to accommodate different heights of grassy terrains.

It is yet a further object of this invention to provide a feces collection device that is compact, lightweight and highly steerable that has an internal cavity with a surface treatment designed for ease of cleaning.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements. Other objects, features and aspects of the present invention are discussed in greater detail below.

BRIEF DESCRIPTION OF THE DRAWINGS

FIG. 10 is a side view of the of the first embodiment collection blade rotor;

FIG. 11 is a top perspective view of the feces collection device in the water jetting mode;

FIG. 12 is a perspective view of the second embodiment collection blade rotor;

DETAILED DESCRIPTION

Figure 1:
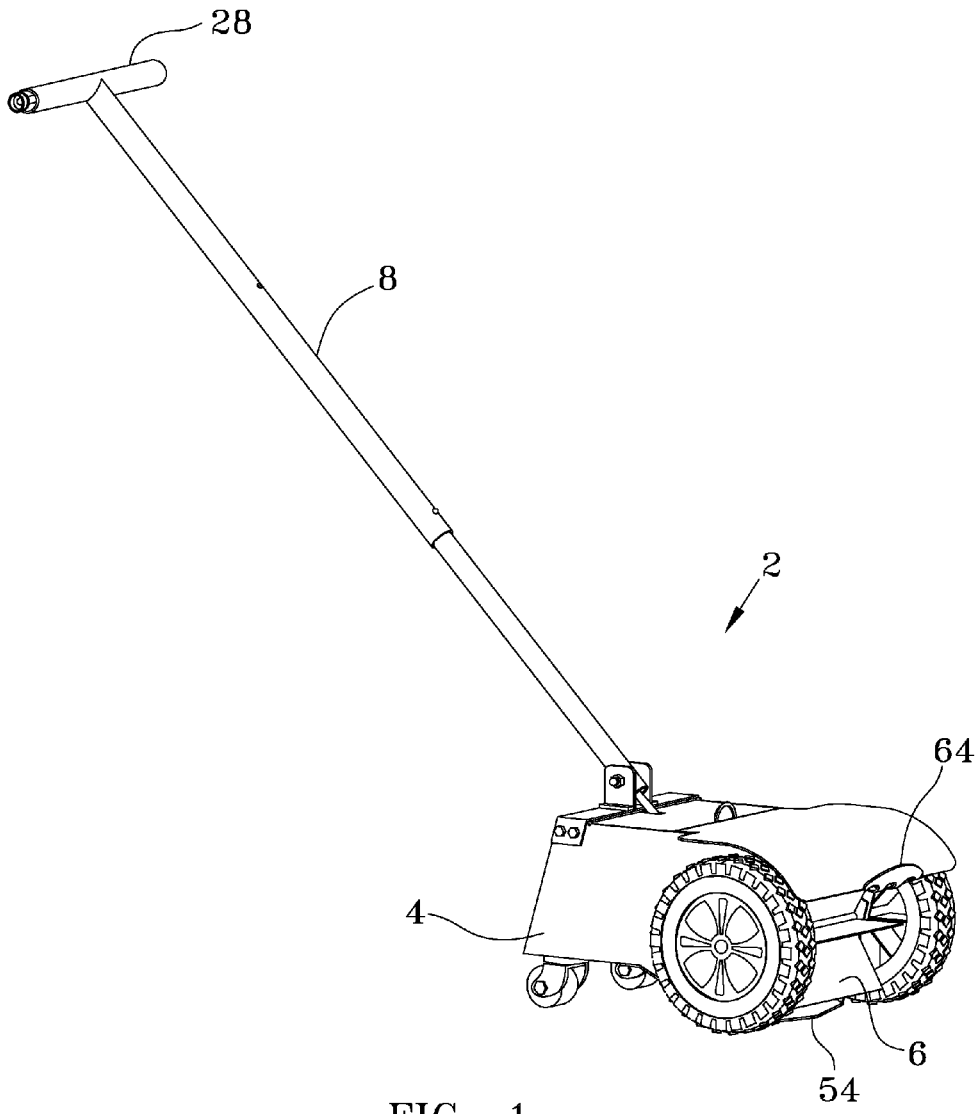
FIG. 1 is a front side perspective view of the feces collection device.
Figure 2:
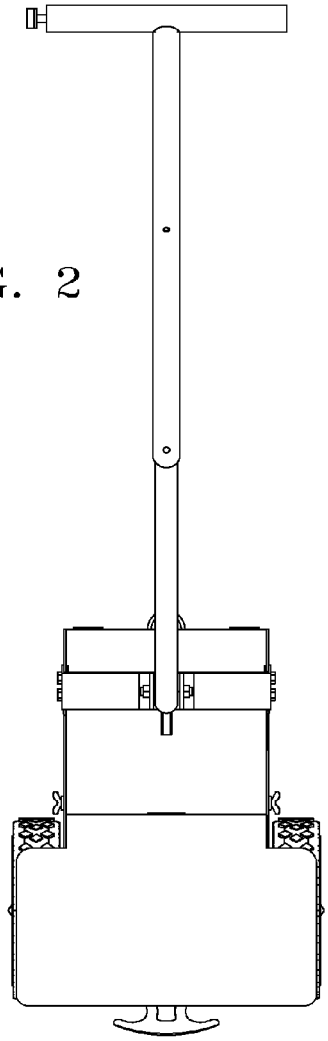
FIG. 2 is a top view of the feces collection device.
Figure 3:
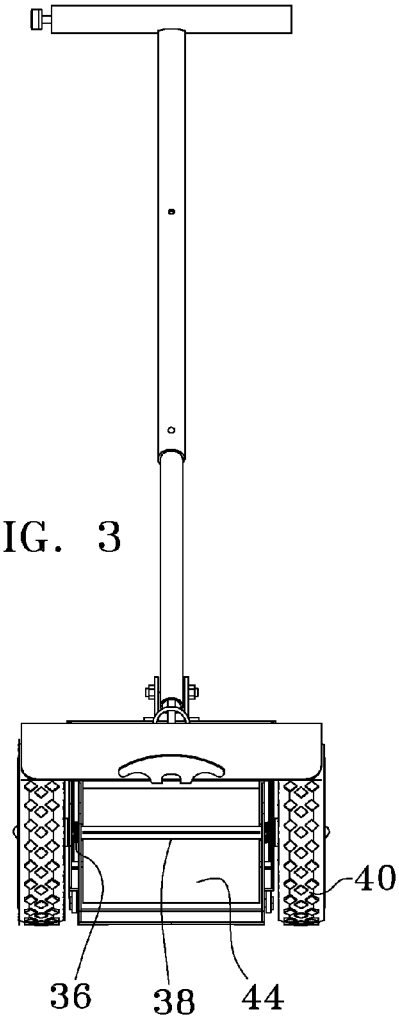
FIG. 3 is a front view of the feces collection device.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

Looking at FIG. 1 it can be seen that the feces collection device 2 has a rollable collection housing assembly 4, a collection blade rotor assembly 6 rotatably affixed at the front of the collection housing assembly 4, and a telescoping handle assembly 8 pivotally attached to the rear of the housing assembly 4.

Looking at the combination of FIGS. 2, 3, 6, 7, 8, 9 and 11 the collection housing assembly 4 has a generally cuboid physical configuration having a fixed bottom plate 10 with two side wall plates 12 extending therefrom to which a top curved front plate 14 and a rear handle bracket 16 are affixed. Bounded by the side wall plates 12, the bottom plate 10 and the handle bracket 16 is a rear disposal hatch 18 which is pivotally mounted to side wall plates 12 and encloses the back end of the collection housing assembly 4. Also pivotally mounted to the side wall plates 12 and residing between the handle bracket 16 and the front plate 14 is a top bag removal hatch 20. On the front bottom of the collection housing assembly 4 is an adjustable, spring loaded scoop 22. The scoop 22 has at least one torsion device 36 that biases the scoop 22 to its fully down position closest to the ground. The sides of the scoop 22 have threaded studs 32 extending normally therefrom and passing through arced slots 34 cut through the side wall plates 12. These arced slots define the rotatable travel of the scoop 22 from its full down to fully up positions. There are threaded fasteners (wingnuts) 35 threadingly engaged with the studs 32 and a flat washer utilized so that the tightening of the threaded fasteners 34 will secure the scoop 22 in a fixed position relative to its fully down position. At the rear of the collection housing there are two fully rotatable caster wheels 24 affixed to the bottom plate 10.

Looking at FIGS. 3, 10, 13 and 14 it can be seen that the collection blade rotor assembly 6 is a multi vaned rotor 42 made of an axle 38 from which a series or set of series of variable length blades 44 extend. The distal and proximate ends of the axle 38 pass through orifices in the side wall plates 12 and are affixed thereafter to substantially identical wheels 40 such that when the wheels rotate, the rotor 42 also rotates within the cavity of the collection housing device 4. A bushing assembly may optionally be affixed to the side wall plates 12 and utilized to stabilize and smooth out the rotation of the axle 38. As can be seen in FIGS. 10 and 12 the rotor assembly 6 may have differing physical configuration of the blades. However common to all of the rotor blade configurations is the sizing of the blades, relative to each other. Experimentation has shown that optimally a series of three blades increasing length works best. In the present invention the front blade is ½ inch shorter than the intermediate blade which is ½ inch shorter than the back blade. In this way the feces is segmented and collected in three horizontal sections. This size differential is best implemented as 1.5, 2 and 2.5 inch long blades. This ½ inch increasing blade length in the direction of rotation for the second and third blades in the three blade series has been experimentally proven to best effect collection of solid feces in the dimensions commonly excreted by dogs. When the rotor 42 is rotated such that the back blade resides perpendicular to the ground there is ⅛ inch clearance between the tip of the back blade and the scoop plate. This tolerance of clearance has been experimentally proven to best effect collection of semi-solid feces. The three blade series is repeated at least two times on the axle 38 to form the multi vaned rotor 42. The leading edge or lip 46 of the longest blade (the back blade) is bent 33 degrees from the plane of the blade away from the direction of counterclockwise rotation as represented by arrow 48. This prevents the collection of unwanted gravel and jamming of gravel between the rotor 42 and the spring loaded scoop 22. Although the lip 46 is bent for the size of gravel commonly encountered there is a broad range of angles that will work better on different sizes of gravel. These range between 10 and 50 degrees. The tip of each of the blades whether bent or not, has been beveled on at least one side to at least 30 degrees. The alternate embodiment blade 43 utilizes the same lip configuration and blade sizing as the preferred embodiment but has the blades configured in a helical manner.

Figure 13:
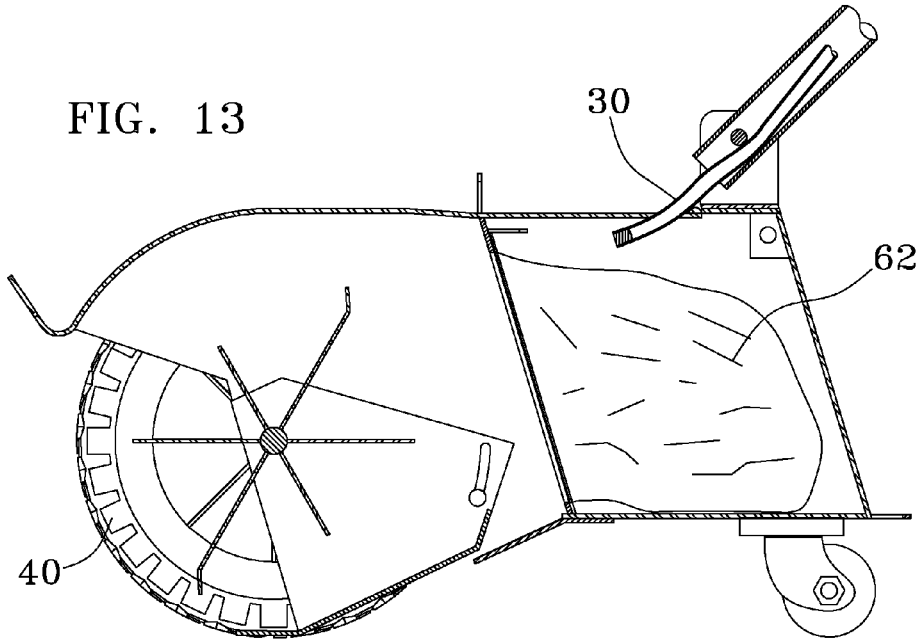
FIG. 13 is a side cross section view of the feces collection device with the scoop in the fully retracted position.
Figure 14:
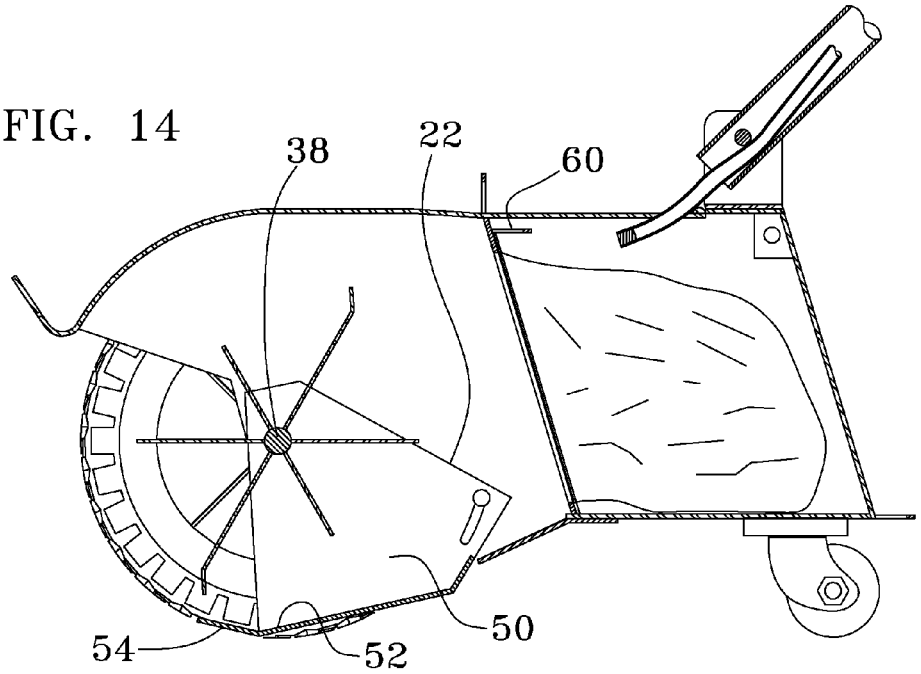
FIG. 14 is a side cross section view of the feces collection device with the scoop in the fully extended position.

Looking at FIGS. 13 and 14 it can be seen that the scoop 22 is a bucket with and open front and back
adapted to ensure that the partial feces contacted and flung backwards by the collection blade rotor assembly 6 travels to its final destination of the internal cavity of the housing assembly 4 rather then back onto the user's feet or legs. The scoop 22 has orifices in its side walls 50 that allow it to be mounted about the axle 38 for limited pivotable motion about the axle 38. The scoop 22 can only move through the range of pivotable motion allowed by the physical interference between the studs 32 extending from the scoop's side walls 50 and the arced slots 34 on the scoop's housing's side wall plates 12 through which the studs 32 pass. In the preferred embodiment, the torsion devices 36 are wound springs with one end affixed to the scoop 22 and the other end affixed to the collection housing assembly 4, although there is a plethora of torsion devices well known in the field that would work equally as well. The scoop's bottom plate 52 has a pointed tip 54 that is bent upward 33 degrees from the plane of the bottom plate 52. This helps eliminate the collection of non fecal mater such a stones and twigs. The pointed tip 54 has an included angle of 114 degrees. This configuration works well to slide under the feces and support it from movement while the three rotor blades dissect the feces into three longitudinal sections and fling them into the internal cavity of the housing 4.

FIGS. 13 and 14 illustrate the movement of the scoop 22 from its upper position (FIG. 13) to its bottom position (FIG. 14). Regardless of the position of the scoop 22, the ⅛ inch clearance between the tip of the back rotor blade and the pointed tip 54 of the scoop's bottom plate 52 is always maintained as both rorate about the axle 38.

Inside the housing 4 there is a feces collection bag retention flange 60 adapted to secure a feces collection bag 62 for the collection of feces flung into the housing by the action of the collection blade rotor assembly 6. The flange 60 is constrained by a set of guides in the housing 4 and may be accessed by opening the top bag removal hatch 22 and sliding out the flange 60 with the attached fecal collection bag 62 for disposal. When there is no fecal collection bag 62 installed, the feces flung into the housing 4 will just remain in the inner cavity. The device 2 can then be emptied by tilting rearward the device 2 with the tip handle 64 and opening rear disposal hatch 18. The tip handle is a curved extension of the top curved front plate 14 and is adapted for three finger operation.

Figure 4:
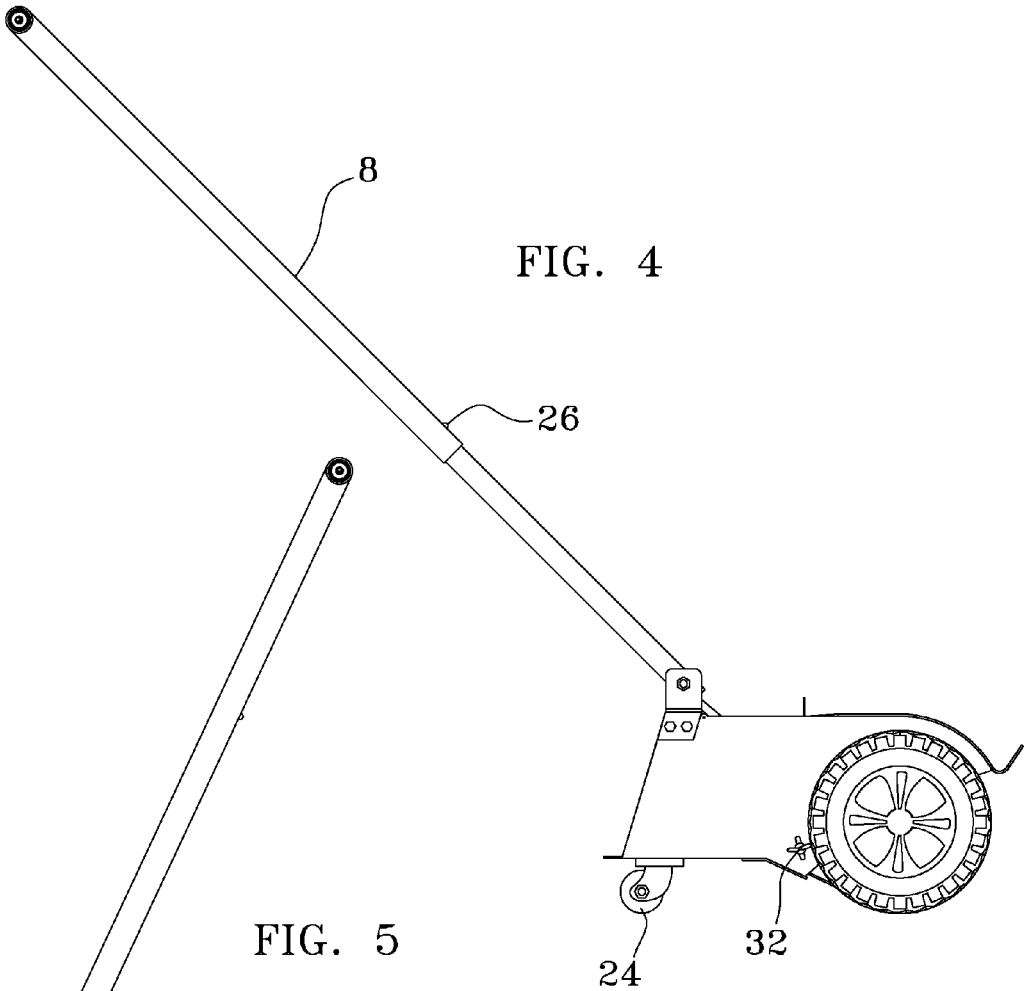
FIG. 4 is a left side view of the feces collection device with the tilting, telescoping handle fully extended.
Figure 5:
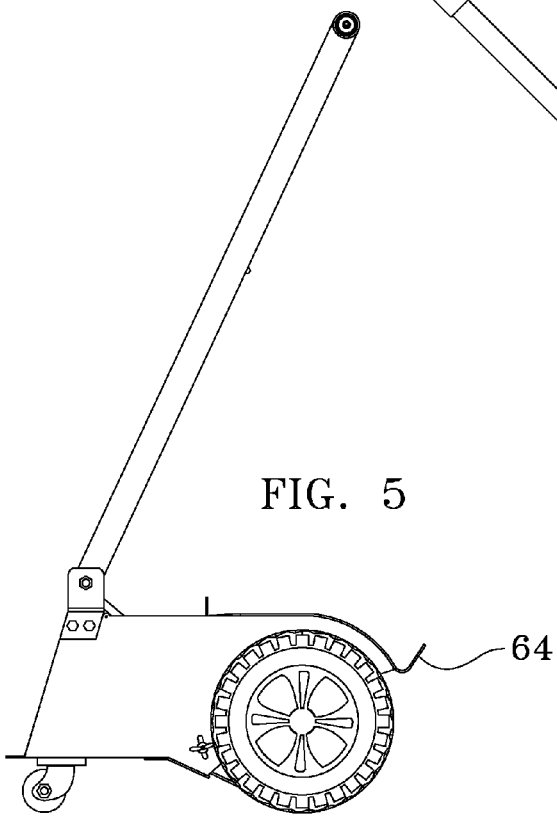
FIG. 5 is a left side view of the feces collection device with the tilting, telescoping handle retracted.
Figure 6:
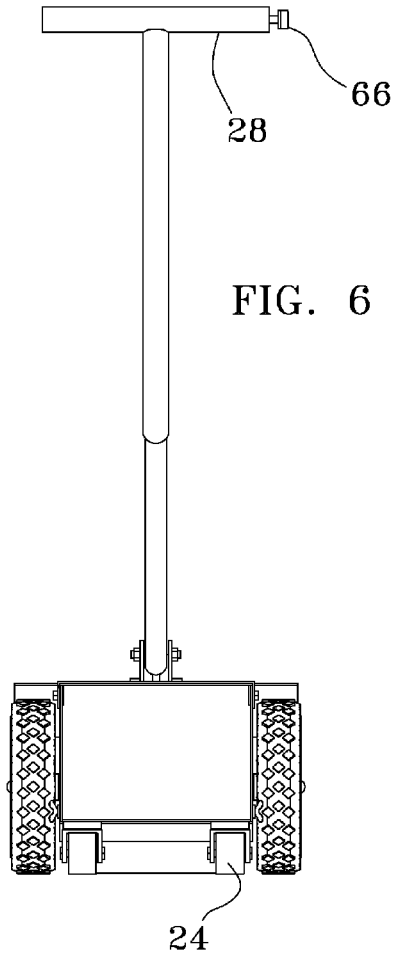
FIG. 6 is a rear view of the feces collection device.
Figure 7:
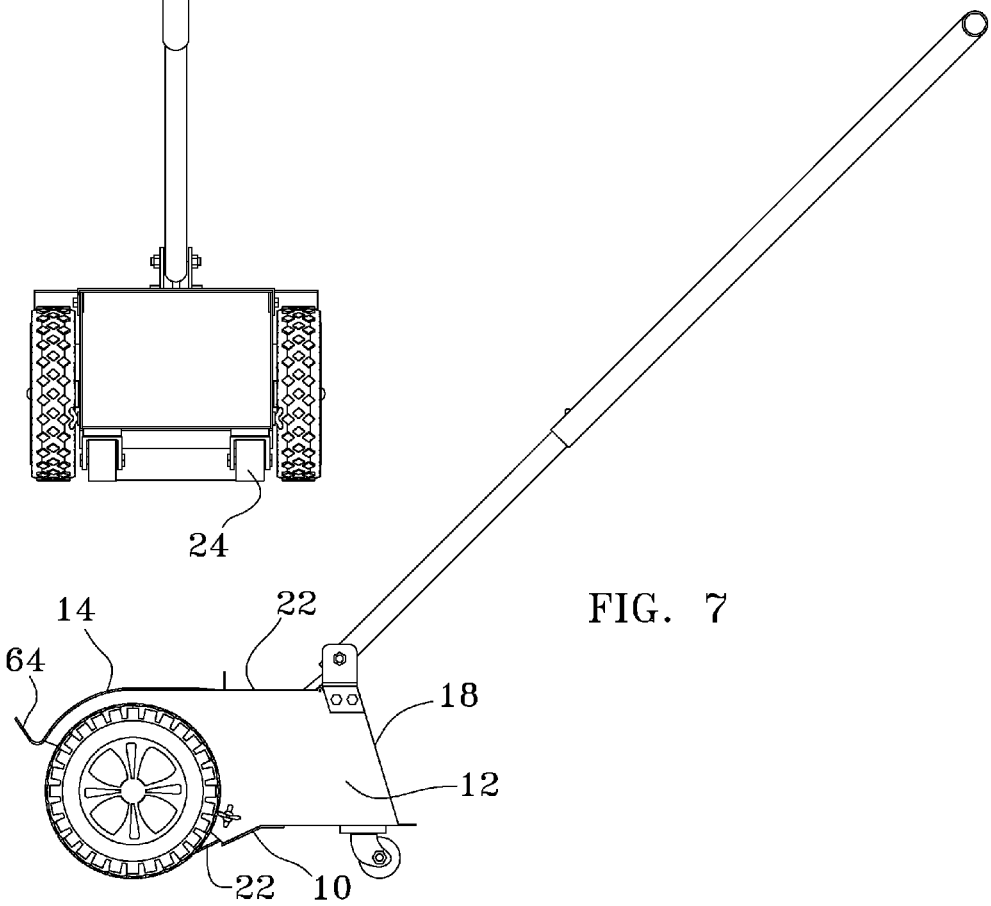
FIG. 7 is a right side view of the feces collection device with the tilting, telescoping handle fully extended.
Figure 8:
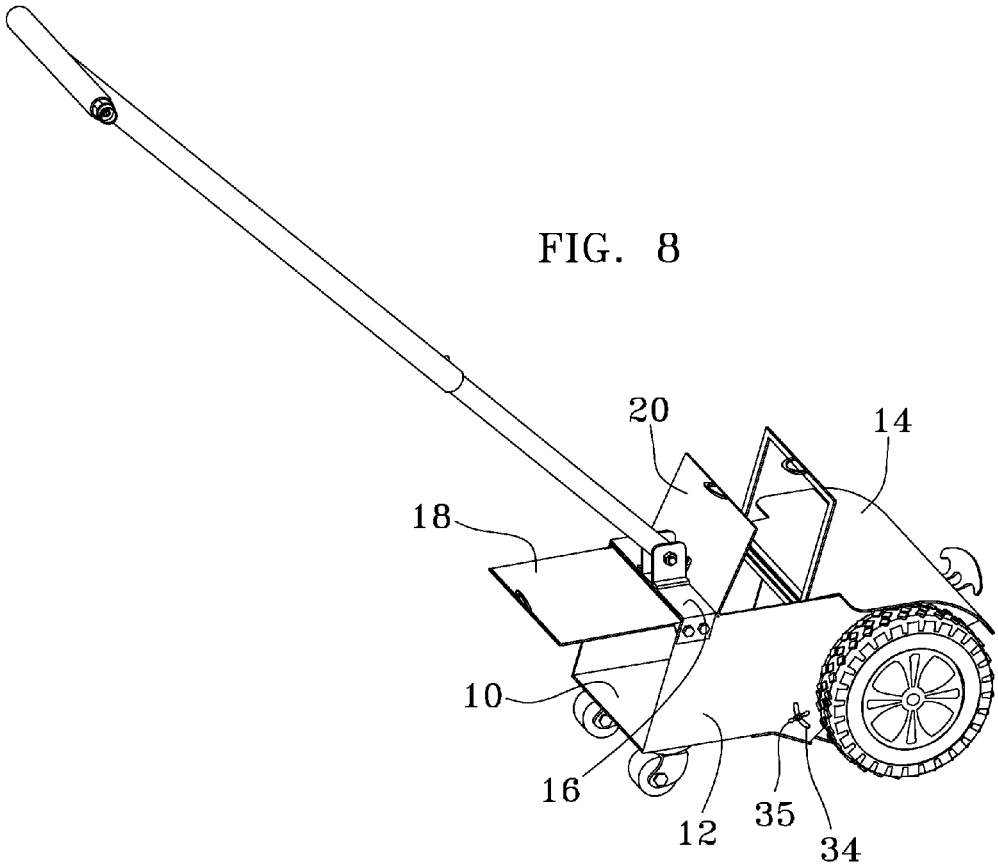
FIG. 8 is a rear perspective view of the feces collection device with the rear disposal hatch and top bag removal hatch opened, and the bag retention flange partially removed.
Figure 9:
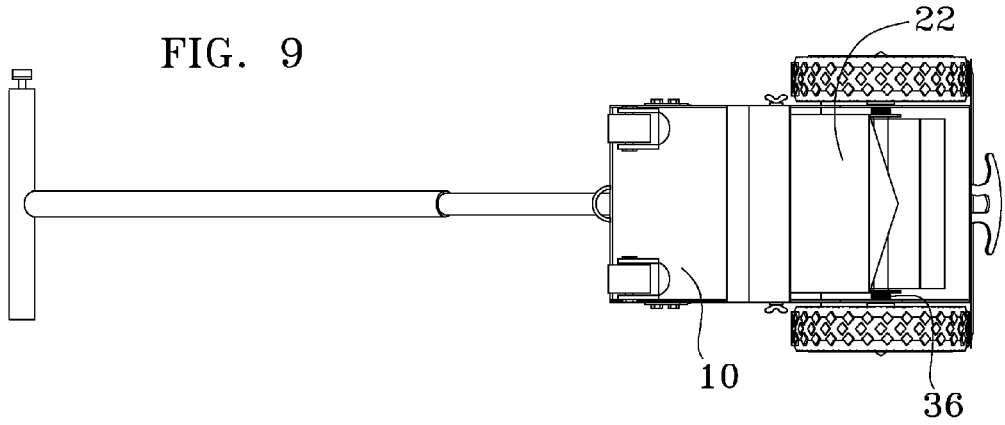
FIG. 9 is a bottom view of the feces collection device.

Looking at FIGS. 4 and 5 it can be seen that the handle assembly 8 is both extendable in a telescoping manner via the handles consecutive hollow tube sizes and the spring loaded locking button 26. The handle t bar 28 is also made of hollow tubing such that a flexible water line 30 can be extended from one side of the t bar 28, down through the hollow handle telescoping tubes and extend down into the collection housing assembly 4 from the top through a slot formed through the bag removal hatch 20. With this design, the handle assembly 8 can be pivoted fore and aft to direct a jetted spray of water throughout the internal cavity of the collection housing assembly 4 to cleanse it. For ease of washing the internal surfaces of the housing 4 and the rotor 42 are to be coated in a non sticking surface treatment or coating such as polytetrafluoroethylene (PTFE). The water is introduced through a hose connector 66 affixed to one side of the t bar 28.

In operation the user need only open the top bag removal 22, slide out the feces collection bag retention flange 60, wrap the open end of a feces collection bag 62 around the flange 60 and reinstall the flange 60. If the surface for feces collection is extremely rocky, the scoop 22 may be raised to a higher position that the torsion springs bias it to, and the threaded fasteners 34 tightened to secure the scoop 22 in a fixed position. Otherwise the scoop 22 will be left in its automatic tensioning mode, biased downward by torsion to the lowest position. The handle assembly 8 is telescopically adjusted to the correct height for the user and the device 2 is pushed over a feces while the user walks at a normal cadence. The combination of the larger front wheels 40 and the pivotable caster wheels 34 at the rear provide optimal turning and steering in tight spaces. The pointed tip 54 of the scoop's bottom plate 52 slides under the feces and the multi vaned rotor 42 segments the feces into three horizontal sections and flings the sections into the internal cavity of the housing 4. If a feces collection bag 62 was not initially installed, the user need only empty the housing 4 by tilting the device 2 rearward with the tip handle 64 and opening rear disposal hatch 18. After emptying the feces collection bag 62 or the housing 4, a hose is attached to the hose connector 66 on the t bar 28, the rear disposal hatch 18 and top bag removal hatch 20 are closed, and the water is turned on. The user tilts the handle assembly 8 fore and aft to flush out the internal cavity of the housing. The end of the water line 30 may optionally have a watter spinning or jetting device to direct the water spray pattern to optimally reach all areas of the internal cavity as is well known in the art.

It is known that the collection blade rotor 42 may be comprised of various combinations of different sized blades in repeating series or not. However experimentation has shown that using 2 series of the three blade grouping with the blade configurations as detailed herein works optimally for the collection of solid and semi solid feces over a wide variety of terrains.

The above description will enable any person skilled in the art to make and use this invention. It also sets forth the best modes for carrying out this invention. There are numerous variations and modifications thereof that will also remain readily apparent to others skilled in the art, now that the general principles of the present invention have been disclosed. It is important, therefore, that the claims be regarded as including such equivalent constructions insofar as they do not depart from the spirit and scope of the present invention.

Having thus described the invention, what is claimed as new and desired to be secured by Letters Patent is as follows:

1. A feces collection device comprising:
- a rollable housing adapted for steerable maneuvering over grassy and gravely ground surfaces;
- a collection blade rotor assembly with a collection blade rotor comprising an axle with at least one series of grouped blades extending normally therefrom, each series of grouped blades comprised of a front blade, an intermediate blade and a rear blade; and
- a push handle assembly affixed to said housing;
- wherein said rotor assembly is rotatably constrained within said housing and wherein said intermediate blade extends further from said axle than said front blade.

2. The feces collection device of claim 1 wherein said back blade extends further from said axle than said intermediate blade.

3. The feces collection device of claim 2 wherein said back blade has a leading edge bent away from a counterclockwise direction of rotation of said collection blade rotor.

4. The feces collection device of claim 3 wherein said collection blade rotor assembly has a first wheel affixed to a distal end of said axle and a second, substantially similar wheel affixed to a proximate end of said axle.

5. The feces collection device of claim 4 wherein said housing has a rear disposal hatch and a top bag removal hatch.

6. The feces collection device of claim 5 wherein said housing further comprises a bag retention flange removably connected to an inside of said housing.

7. The feces collection device of claim 4 wherein said housing has an adjustable scoop that pivots in a limited range about said axle.

8. The feces collection device of claim 7 wherein said scoop has a leading edge formed to a point.

9. The feces collection device of claim 8 further comprising at least one torsional means coupled between said housing and said scoop so as to bias said scoop into a fully down position.

10. The feces collection device of claim 4 wherein said push handle assembly is hollow and pivotally connected to said housing and has a water line residing therein and that extends therefrom and passes into said housing through a slot formed in said housing.

11. The feces collection device of claim 10 wherein said push handle assembly has a hose fitting affixed to a side of a tee bar affixed to said push handle.

12. The feces collection device of claim 1 wherein said housing has at least one fully rotatable caster wheel affixed thereon.

13. A feces collection device comprising:
- a housing defining an internal cavity;
- at least one rotatable rear wheel affixed to said housing;
- a pivoting, telescoping hollow handle with a water jet cleaning system integrated therein, affixed at a rear of said housing;
- a disposal hatch pivotally disposed at the rear of said housing;
- a bag removal hatch pivotally disposed at the top of said housing;
- a disposal bag retention flange, removably affixed in said housing adjacent said bag removal hatch;
- a rotatable collection blade rotor assembly comprised of an axle with at least one series of blades extending normally therefrom, said collection blade rotor assembly that is directly coupled to at least two front wheels, and is rotatably mounted such that said blades reside in said housing;
- an adjustable scoop with a projecting point thereon that extends below said blades and is pivotally affixed about said axle.

14. The feces collection device of claim 13 wherein said series of blades comprises a front blade, and intermediate blade and a back blade wherein said back blade extends further from said axle than said intermediate blade and said intermediate blade extends further from the axle than does said front blade.

15. The feces collection device of claim 14 wherein said back blade has a leading edge bent away from a counterclockwise direction of rotation of said collection blade rotor assembly.

* * * * *